US011788174B1

(12) United States Patent
Du et al.

(10) Patent No.: US 11,788,174 B1
(45) Date of Patent: Oct. 17, 2023

(54) RARE EARTH HARD ALLOY AND PREPARATION METHOD AND APPLICATION THEREOF

(71) Applicants: Central South University, Hunan (CN); JiangXi University of Science and Technology, Jiangxi (CN)

(72) Inventors: Yong Du, Jiangxi (CN); Jian Lv, Jiangxi (CN); Keke Chang, Jiangxi (CN); Weibin Zhang, Jiangxi (CN); Ming Lou, Jiangxi (CN); Zepeng Li, Jiangxi (CN); Yangqing Lv, Jiangxi (CN)

(73) Assignees: Central South University, Changsha (CN); JiangXi University of Science and Technology, Ganzhou (CN)

( * ) Notice: Subject to any disclaimer, the term of this patent is extended or adjusted under 35 U.S.C. 154(b) by 0 days.

(21) Appl. No.: 18/203,065

(22) Filed: May 30, 2023

(30) Foreign Application Priority Data

Jun. 2, 2022 (CN) ..... 202210625714.6

(51) Int. Cl.
*C22C 29/08* (2006.01)
*C22C 29/00* (2006.01)
*C22C 1/051* (2023.01)

(52) U.S. Cl.
CPC ..... *C22C 29/08* (2013.01); *C22C 1/051* (2013.01); *C22C 29/005* (2013.01)

(58) Field of Classification Search
CPC ..... C22C 29/08
See application file for complete search history.

(56) References Cited

U.S. PATENT DOCUMENTS 4,919,718 A * 4/1990 Tiegs ..... C22C 29/08 419/13
4,948,676 A 8/1990 Darracq et al.
5,089,047 A * 2/1992 Buljan ..... C22C 29/067 75/238

FOREIGN PATENT DOCUMENTS

CN 101709422 A 5/2010
CN 102154582 A 8/2011
(Continued)

OTHER PUBLICATIONS

Viswanadham, R.K., Lindquist, P.G., Peck, J.A. (1983). Preparation and Properties of WC-(Ni, Al) Cemented Carbides. In: Viswanadham, R.K., Rowcliffe, D.J., Gurland, J. (eds) Science of Hard Materials. Springer, Boston, MA. https://doi.org/10.1007/978-1-4684-4319-6_48 pp. 873-889 (Year: 1983).*
(Continued)

*Primary Examiner* — Christopher S Kessler

(57) ABSTRACT

The present invention provides a rare earth hard alloy and a preparation method and application thereof. The rare earth hard alloy includes 6 to 15 wt % of a binding phase and the balance of a hard phase, wherein the binding phase includes 30 to 50 wt % of $Ni_3Al$, 0.1 to 0.5 wt % of a rare earth element and the balance of Ni. According to the rare earth hard alloy provided by the invention, the Ni—$Ni_3Al$-rare earth element (e.g., Ni—$Ni_3Al$—Y)-based binding phase is strengthened by $Ni_3Al$, and an ordered strengthening phase is formed and is diffused and distributed in the binding phase, such that the rare earth hard alloy has a better high-temperature oxidation resistance, a better room-temperature fracture toughness and a better high-temperature bending strength than a conventional hard alloy.

10 Claims, 4 Drawing Sheets

(56) References Cited

FOREIGN PATENT DOCUMENTS

| | | | |
|---|---|---|---|
| CN | 109402479 | A | 3/2019 |
| CN | 111378885 | A | 7/2020 |
| JP | S5831061 | A | 2/1983 |

OTHER PUBLICATIONS

Notice of Allowance of counterpart Chinese Patent Application No. 202210625714.6 dated Dec. 28, 2022.

1st Office Action of counterpart Chinese Patent Application No. 202210625714.6 dated Oct. 28, 2022.

Kai Zhang et al., Microstructure and composition of the grain/binder interface in WC—Ni3Al composites, Int. Journal of Refractory Metals and Hard Materials, Feb. 6, 2014, pp. 88-93, vol. 44, Elsevier.

Jian-Zhan Long et al., WC—Ni3Al—B composites prepared through Ni+Al elemental powder route, Trans. Nonferrous Met. Soc. China, 2012, pp. 847-852, vol. 22, Elsevier.

* cited by examiner

RARE EARTH HARD ALLOY AND PREPARATION METHOD AND APPLICATION THEREOF

CROSS-REFERENCE TO RELATED APPLICATIONS

The present application claims the benefit of Chinese Patent Application No. 202210625714.6 filed on Jun. 2, 2022, the contents of which are incorporated herein by reference in their entirety.

FIELD OF THE INVENTION

The present invention relates to the technical field of rare earth hard alloys, and in particular to a rare earth hard alloy and a preparation method and application thereof.

BACKGROUND OF THE INVENTION

Hard alloys have great mechanical properties, a good chemical stability and a great corrosion resistance at both normal temperatures and high temperatures, making them widely applied to the manufacture of metal cutting tools, mine tools and metal forming dies. However, with the development of science and technology, difficult-to-machine materials such as high-strength steels, hot-strength alloys and heat-resistant super alloys have emerged continuously, whitch increases the requirements for the cutting property of hard alloy tools. The properties of conventional hard alloys have gradually become difficult to meet the needs of the actual industrial production.

In order to improve the high-temperature properties of the existing hard alloys, adopting a novel binding phase $Ni_3Al$ instead of a Co binding phase has become an effective way. For example, China Patent application "Hard Alloy Taking Nickel-Aluminium Intermetallic Compound $Ni_3Al$ as binding phase and Preparation Method" (Publication Number: CN102154582A) discloses a hard alloy having $Ni_3Al$ as a binding phase, and a carbide as a hard phase, wherein Y is 0.005 to 0.050 wt %, and the volume percent of the binding phase is from 10 to 40%; a preparation method of the hard alloy sequentially comprising the following steps of: uniformly mixing 5.04 to 50.30 wt % of nickel powders with aluminium powders and the balance of carbide powders according to a proportion of components of $Ni_{24}Al$; putting and spreading out the mixture in a graphite container to a thickness of less than or equal to 50 mm, heating the mixture at a speed of less than or equal to 5° C./min to a temperature of from 1100° C. to 1200° C. at a non-oxidizing atmosphere for 1 hour or above, and after cooling obtaining a mixture of carbide and $Ni_3Al$; milling, crushing and sieving the mixture so as to obtain mixed powders of carbide and $Ni_3Al$ with a size of 120 μm or below; carrying out deoxidization pretreatment on the mixed powders, followed by adding an anhydrous yttrium nitrate alcoholic solution according to the quality percentage of Y in the final hard alloy (0.0050 wt % to 0.0503 wt %) and wet-milling for 18 to 36 hours so as to obtain a mixture; making the mixture into a green compact; and carrying out a low-pressure liquid phase sintering on the green compact at a temperature of from 1350° C. to 1550° C. so as to obtain the hard alloy. The hard alloy has a uniform structure, a high densification, a high strength, a good toughness and a wear resistance and an excellent high-temperature oxidation resistance and an excellent corrosion resistance; and the process is simple and has low costs. Although the WC—$Ni_3Al$—Y hard alloy prepared according to the method is toughened with Y, its fracture toughness is difficult to reach the level of a WC—Co hard alloy, and thus the WC—$Ni_3Al$—Y hard alloy is difficult to meet the demands of engineering applications, the reasons are as follows: $Ni_3Al$ is an intermetallic compound in which metal and covalent bonds coexist between its atoms, and is a brittle phase.

China Patent "Nbc-Based Lightweight Metal Cermet Alloy with High Wearing Resistance and Toughness and Preparation Method Thereof" (Publication Number: CN109402479A) discloses an NbC-based lightweight metal cermet alloy with a high wearing resistance and a toughness and a preparation method thereof. According to the invention, the metal cermet alloy comprises the following components, in percentage by mass, 35 to 90% of NbC, 5 to 55% of (Nb, M)C, 5 to 30% of WC, 0 to 30% of TiC, 0 to 30% of TiN, 0 to 25% of Ti(C, N), 0 to 20% of Ni, 0 to 20% of Mo, 0 to 20% of Cr, 0 to 15% of Fe, 0 to 15% of Co, 0 to 20% of Mo2C, 0 to 15% of TaC, 0 to 2.5% of ZrC serving as a grain inhibitor, 0 to 5% of VC, 0 to 5% of Cr2C3, 0 to 1.2% of carbon black, etc. The above raw materials are blended into a mixture, the mixture is loaded into a stainless steel ball mill tank, anhydrous ethanol or hexane and other media, stearic acid and paraffin or PVA are added, the mixture is ball milled, sieved and mould pressed into a blank material, and the blank material is sintered and cooled to obtain the NbC-based lightweight metal cermet alloy with the high wearing resistance and toughness. The NbC-based lightweight metal cermet alloy prepared according to the method can overcome the defects existing in conventional WC hard alloys (lack of high-temperature wearing resistance, a high specific gravity); moreover, the NbC-based lightweight metal cermet alloy is low in price, simple in process and suitable for industrial production. However, according to the method, the components of the hard phase are complicated, the preparation process is difficult to control, and the binding phase is not strengthened, thus making its high-temperature property difficult to meet the requirements.

SUMMARY OF THE INVENTION

In view of the above problems in the prior art, one of the purposes of the present invention is to provide a rare earth hard alloy, wherein a Ni-based binding phase is strengthened through $Ni_3Al$-rare earth element (e.g., $Ni_3Al$—Y), and an ordered strengthening phase is formed with $Ni_3Al$ as nucleation sites and is diffused and distributed in the binding phase, such that the rare earth hard alloy has a greater room-temperature fracture toughness and a greater high-temperature bending strength than a conventional hard alloy. Another purpose of the invention is to provide a preparation method of a rare earth hard alloy corresponding to said one of the objectives.

In order to achieve the above purposes, in a first aspect, the invention provides a rare earth hard alloy, comprising, based on the weight of the rare earth hard alloy, 6 to 15 wt % of a binding phase and the balance of a hard phase. Based on the weight of the binding phase, the binding phase includes 30 to 50 wt % of $Ni_3Al$, 0.1 to 0.5 wt % of a rare earth element and the balance of Ni. The rare earth element is one or more selected from Ce, Y, Sm, Nd and La, preferably Y.

In some embodiments of the invention, based on the weight of the hard phase, the hard phase includes 30 to 50 wt % of NbC, e.g., 30 wt %, 35 wt %, 40 wt %, 45 wt %, 50 wt % and any value therebetween, and the balance of WC.

In some embodiments of the invention, the WC has a particle size of 0.6 to 3.0 μm.

In the invention, a $A_3B$ ordered phase precipitate is precipitated by adding $Ni_3Al$ in the Ni binding phase of the rare earth hard alloy, thus strengthening the binding phase of the rare earth hard alloy, improving both the strength and the wear resistance of the alloy. And the binding phase can be strengthened until 800° C., which greatly improves the high-temperature bending strength of the alloy. Ni atoms all form metallic bonds and have an excellent plasticity, but have low mechanical properties. A single Ni metal as a binding phase of a hard alloy may lead to poor mechanical properties of the rare earth hard alloy, especially a poor high-temperature bending strength. While a Ni—$Ni_3Al$ binding phase is similar to a nickel-based high-temperature alloy, $Ni_3Al$ as a strengthening phase can strengthen the Ni-based binding phase, thereby obtaining excellent high-temperature properties.

According to the invention, the adopted Ni—$Ni_3Al$-rare earth element (e.g., Ni—$Ni_3Al$—Y) binding phase is similar to the nickel-based high-temperature alloy, with Ni as a main phase and brittle $Ni_3Al$ as a strengthening phase, which can strengthen the Ni-based binding phase having great plasticity and toughness, thereby solving the problem of brittleness caused by single use of a $Ni_3Al$—Y binding phase, and also solving the problem of insufficient mechanical properties caused by using a Ni binding phase alone. Furthermore, for the addition of a rare earth element (e.g., Y), in the invention, the rare earth element is added to stabilize and avoid the $Ni_3Al$ phase from being decomposed in the Ni-based binding phase and then not acting as a strengthening phase. For example, in the prior art, the rare earth element Y is added to toughen the $Ni_3Al$ binding phase.

In the meantime, WC+NbC is used as a hard phase in the rare earth hard alloy provided by the invention, NbC itself has better high-temperature properties, while using NbC in the proportion of the invention can improve the interface bonding ability between the hard phase and the binding phase Ni—$Ni_3Al$-rare earth element (e.g., Ni—$Ni_3Al$—Y) and improve the fracture toughness of the alloy.

In a second aspect, the invention provides a preparation method of the rare earth hard alloy, comprising the steps of:

S1. mixing $Ni_3Al$ powders and a rare earth element source solution, and performing a first wet-milling treatment to obtain a first material;

S2. performing a high-temperature treatment on the first material to obtain a second material;

S3. mixing the second material, NbC powders, WC powders and Ni powders and performing a second wet-milling treatment to obtain a mixture; and S4. drying, pressing and sintering the mixture to obtain the hard alloy.

In some embodiments of the invention, in the step S1, the first wet-milling treatment is performed for 6 to 12 h.

In the invention, the first wet-milling treatment (pre-wet milling) in step Si contributes to mixing and dispersing the $Ni_3Al$ powders and the rare earth element (e.g., Y). Since the $Ni_3Al$ pre-alloy powder is brittle, pre-wet milling helps to grind and refine the $Ni_3Al$ pre-alloy powder, which helps to densify it in the subsequent sintering process. In the meantime, mixing with the rare earth element source solution before wet milling and sintering helps $Ni_3Al$ and the rare earth element to mix and adsorb each other to form a primary solid solution in order to avoid the separation of the $Ni_3Al$ from the rare earth element in the subsequent second wet-milling treatment process, which helps to stabilize the $Ni_3Al$ phase and a precipitated $A_3B$ ordered phase in the sintering process, and reduce the decomposition of the $Ni_3Al$ phase and the precipitated strengthening phase.

In some embodiments of the invention, in the rare earth element source solution, the rare earth element is one or more selected from Ce, Y, Sm, Nd and La, preferably Y.

In some embodiments of the invention, the rare earth element source solution is a salt solution of the rare earth element, preferably an anhydrous nitrate solution. In the invention, the anhydrous nitrate solution of the rare earth element refers to a solution formed by dissolving a rare earth element reagent in an anhydrous solvent (e.g., an alcohol solvent, e.g., methanol, ethanol).

In some embodiments of the invention, the rare earth element source solution (the anhydrous nitrate solution of the rare earth element) is preferably an anhydrous yttrium nitrate alcoholic solution or an anhydrous cerium nitrate alcoholic solution.

In the invention, the concentration of the anhydrous yttrium nitrate alcoholic solution or the anhydrous cerium nitrate alcoholic solution is related to the content of the rare earth element in the rare earth hard alloy, the liquid-solid ratio during wet milling, the wet-milling temperature and other factors. For example, by a total weight of 100% of the $Ni_3Al$ powder, yttrium in the anhydrous yttrium nitrate alcoholic solution and the Ni powder, the $Ni_3Al$ powder is present in an amount of from 30 to 50%, and yttrium in the rare earth element source solution is present in an amount of from 0.1 to 0.5%.

In the invention, in the anhydrous yttrium nitrate alcoholic solution or the anhydrous cerium nitrate alcoholic solution, the chemical formula of yttrium nitrate is $Y(NO_3)_3 \cdot 5H_2O$, the chemical formula of cerium nitrate is $Ce(NO_3)_3 \cdot 6H_2O$, ethanol serves as the solvent, and the anhydrous yttrium nitrate alcoholic solution or the anhydrous cerium nitrate alcoholic solution can be obtained by dissolving yttrium nitrate or cerium nitrate in ethanol respectively.

In the invention, the addition of the rare earth element source solution can stabilize and avoid the $Ni_3Al$ phase from being decomposed into alumina oxide in the Ni-based binding phase and then not acting as a strengthening phase. The solvent alcohol (e.g., ethanol) serves as a wet-milling medium, which is volatilized once dried.

In some embodiments of the invention, in the step S2, the high-temperature treatment is performed at a temperature of from 900 to 1000° C. Preferably, the high-temperature treatment is performed under a vacuum condition, preferably a vacuum condition of from 0.01 to 0.1 Pa. The rare earth element and the $Ni_3Al$ are chemically bonded, which improves the stability of $Ni_3Al$-rare earth element in the alloy, and then stably forms the $A_3B$ ordered precipitation phase.

In the invention, the mixing of the rare earth element source solution and the $Ni_3Al$ powder helps to achieve uniform mixing at a molecular level, avoiding the problem of non-uniform mixing of the $Ni_3Al$ and the rare earth element. The uniformly-mixed $Ni_3Al$+rare earth element mixture (the first material) is subjected to a high-temperature treatment, and under a high-temperature condition, the $Ni_3Al$ and the rare earth element are chemically bonded, which helps to improve the stabilization effect of rare earth element on the $Ni_3Al$ phase. The vacuum condition helps to reduce the oxygen content.

In some embodiments of the invention, in the step S3, the second wet-milling treatment is performed for 18 to 36 h.

In some embodiments of the invention, the WC powder has a particle size of from 0.6 to 3.0 μm.

According to the invention, there is no strict limit on the particle sizes of the $Ni_3Al$ powder, the NbC powder and the Ni powder, and thus they can be determined by those skilled in the art according to the actual situation.

According to the invention, the first wet-milling treatment and the second wet-milling treatment can be performed in a ball mill at a temperature of from 10 to 30° C. with a liquid-solid ratio of from 150 to 300 ml/kg.

In some embodiments of the invention, by a total weight of 100% of the $Ni_3Al$ powder, the rare earth element in the rare earth element source solution and the Ni powder (i.e., the binding phase), the $Ni_3Al$ powder is present in an amount of from 30 to 50%, the rare earth element in the rare earth element source solution is present in an amount of from 0.1 to 0.5%, and the balance is the Ni powder.

In some embodiments of the invention, by a total weight of 100% of the NbC powder and the WC powder, the NbC powder is present in an amount of from 30 to 50 wt %, and the balance is the WC powder.

In the invention, by a total weight of 100% of the $Ni_3Al$ powder, the rare earth element in the rare earth element source solution, the Ni powder, the NbC powder and the WC powder, the rare earth element in the rare earth element source solution is present in an amount of from 0.006 to 0.075%, and the $Ni_3Al$ powder added is present in an amount of from 1.8 to 7.5%. By a total weight of 100% of the $Ni_3Al$ powder, the rare earth element in the rare earth element source solution, the Ni powder, the NbC powder and the WC powder, the $Ni_3Al$ powder, the rare earth element in the rare earth element source solution and the Ni powder added (the binding phase) is presented in an amount of from 6 to 15%, and the balance is the NbC powder and the WC powder (the hard phase).

In the invention, the mass of the rare earth element in the rare earth element source solution refers to the mass of the rare earth element contained in the rare earth element source solution.

In some embodiments of the invention, in the step S4, the sintering treatment is performed at a temperature of from 1410° C. to 1500° C.

According to the invention, there is no strict limit on the drying and pressing treatments, and thus they can be determined by those skilled in the art according to the actual situation.

In the invention, the $Ni_3Al$ powder is added in the wet-milling process, and then the $Ni_3Al$ precipitate to form a $A_3B$ ordered phase precipitate in the liquid phase sintering process, so as to produce precipitation strengthening for the binding phase. And the rare earth element (e.g., Y) can stabilize the $Ni_3Al$ and the $A_3B$ ordered phase precipitate.

In a third aspect, the invention provides a rare earth hard alloy prepared according to the preparation method according to the second aspect above. Based the weight of the rare earth hard alloy, the rare earth hard alloy includes 6 to 15 wt % of a binding phase and the balance of a hard phase, wherein based on the weight of the binding phase, the binding phase includes 30 to 50 wt % of $Ni_3Al$, 0.1 to 0.5 wt % of a rare earth element and the balance of Ni. Base on the weight of the hard phase, the hard phase includes 30 to 50 wt % of NbC and the balance of WC. The rare earth element is one or more selected from Ce, Y, Sm, Nd and La, preferably Y.

In a fourth aspect, the invention also provides use of the rare earth hard alloy according to the first aspect above and/or the rare earth hard alloy prepared by the preparation method according to the second aspect above in a tool base, especially in a tool base used in a high-temperature working condition (e.g., 800° C. to 1200° C.). For example, according to the invention, the rare earth hard alloy is used to cut grade 316 L series stainless steel, and has a significantly improved adhesive wear resistance, and has a service life of more than three times of an ordinary hard alloy.

In a fifth aspect, the invention also provides a tool base, especially in a tool base used in a high-temperature working condition (e.g., 800° C. to 1200° C.), wherein the tool base comprises the rare earth hard alloy according to the first aspect above and/or the rare earth hard alloy prepared by the preparation method according to the second.

Compared with the prior art, the present invention has at least one of the following beneficial effects.

1) According to the rare earth hard alloy provided by the invention, the Ni—$Ni_3Al$-rare earth element (e.g., Y)-based binding phase is strengthened by $Ni_3Al$, and an ordered strengthening phase is formed and is diffused and distributed in the binding phase, such that the rare earth hard alloy has a better high-temperature oxidation resistance, a better room-temperature fracture toughness and a better high-temperature bending strength than a conventional hard alloy;

2) in the rare earth hard alloy provided by the invention, WC—NbC is utilized as a hard phase and has a better high-temperature properties than using single WC as the hard phase; and the addition of Nb can improve the interface bonding ability between the hard phase and the binding phase Ni—$Ni_3Al$-rare earth element (e.g., Y) and improve the fracture toughness of the alloy; and 3) in the preparation method of the rare earth hard alloy provided by the invention, the mixing of the rare earth element source solution and the $Ni_3Al$ powder helps to achieve uniform mixing at a molecular level, avoiding the problem of non-uniform mixing of the $Ni_3Al$ and the rare earth element; the uniformly-mixed $Ni_3Al$+rare earth element mixture (the first material) is subjected to a high-temperature treatment, and under a high-temperature condition, the $Ni_3Al$ and the rare earth element are chemically bonded so as to avoid the separation in the following wet-milling treatment, and rendering the rare earth element accurately dispersing around the $Ni_3Al$ phase and the precipitation strengthening phase, which helps to improve the stabilization effect of rare earth element on the $Ni_3Al$ phase and reduce the addition amount of rare earth (the rare earth element is usually presented in an oxide form, and excessive content is harmful to the hard alloy); and also, the vacuum condition helps to reduce the oxygen content of the $Ni_3Al$ +rare earth element mixture (the second material).

DETAILED DESCRIPTION

Figure 1:
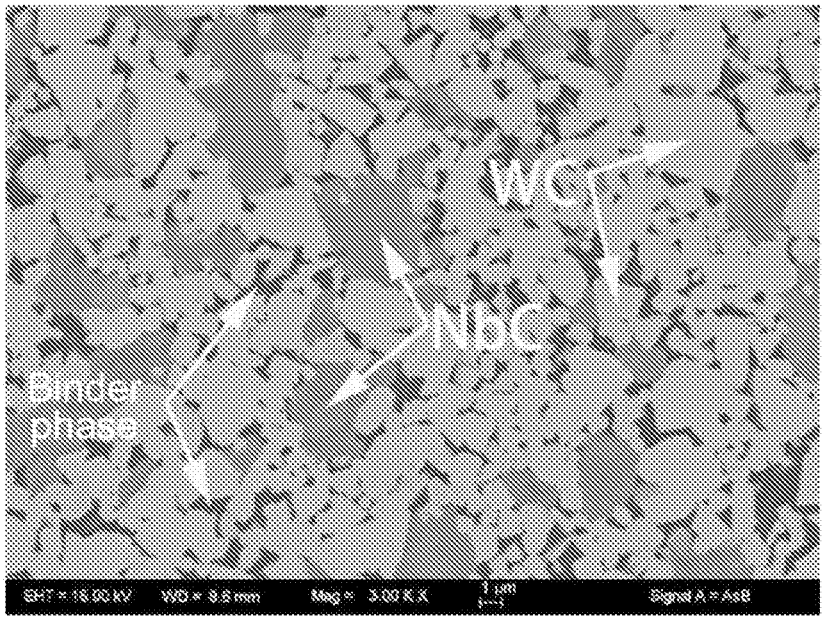
FIG. 1 is a typical structure of a rare earth hard alloy of the present invention.

The present invention is described in detail by means of examples below, but the scope of protection of the present invention is not limited to the following description.

Where specific conditions are not specified in the examples, conventional conditions or those recommended by the manufacturer are followed. The reagents or instruments used without specifying the manufacturer are all conventional products that can be obtained by means of market purchase. NbC powder, Ni powder and NbC powder used in the following examples are all conventional commercially-available products.

Example 1

In the example, the contents of $Ni_3Al$, Y and Ni as a binding phase account for 6% of the total content of a hard phase and the binding phase, and WC powder has a particle size of 0.6 μm.

Example 1 provides a rare earth hard alloy, a preparation method of which is as follows:

(1) $Ni_3Al$ powder and an anhydrous yttrium nitrate alcoholic solution were mixed and subjected to a first wet-milling treatment for 6 h to obtain a first material; wherein the amount of the added $Ni_3Al$ powder accounted for 30 wt % of that of the binding phase, and the amount of yttrium in the anhydrous yttrium nitrate alcoholic solution added accounted for 0.1 wt % of that of the binding phase;

(2) the first material was subjected to a high-temperature treatment at 900° C. under a vacuum condition of 0.01 Pa to obtain a second material;

(3) NbC powder, WC powder and Ni powder were added into the second material and wet milled again for 18 h to obtain a mixture; wherein the total amount of the WC powder accounted for 70 wt % of that of the hard phase, the amount of the added NbC powder accounted for 30 wt % of that of the hard phase, and the amount of the added Ni powder accounted for 69.9 wt % of that of the binding phase; and (4) the mixture was spray dried and compacted, and the green compact was subjected to a low-pressure liquid phase sintering at 1500° C. to obtain a WC—NbC—(Ni—$Ni_3Al$—Y) rare earth hard alloy.

Example 2

In the example, the contents of $Ni_3Al$, Y and Ni as a binding phase account for 6% of the total content of a hard phase and the binding phase, and WC powder has a particle size of 1.5 μm.

Example 2 provides a rare earth hard alloy, a preparation method of which is as follows:

(1) $Ni_3Al$ powder and an anhydrous yttrium nitrate alcoholic solution were mixed and subjected to a first wet-milling treatment for 9 h to obtain a first material; wherein the amount of the added $Ni_3Al$ powder accounted for 40 wt % of that of the binding phase, and the amount of yttrium in the anhydrous yttrium nitrate alcoholic solution added accounted for 0.3 wt % of that of the binding phase;

(2) the first material was subjected to a high-temperature treatment at 950° C. under a vacuum condition of 0.05 Pa to obtain a second material;

(3) NbC powder, WC powder and Ni powder were added into the second material and wet milled again for 27 h to obtain a mixture; wherein the total amount of the WC powder accounted for 60 wt % of that of the hard phase, the amount of the added NbC powder accounted for 40 wt % of that of the hard phase, and the amount of the added Ni powder accounted for 59.7 wt % of that of the binding phase; and (4) the mixture was spray dried and compacted, and the green compact was subjected to a low-pressure liquid phase sintering at 1500° C. to obtain a WC—NbC—(Ni—$Ni_3Al$—Y) rare earth hard alloy, i.e., WC-37.6% NbC-6% (Ni—$Ni_3Al$—Y).

Example 3

In the example, the contents of $Ni_3Al$, Y and Ni as a binding phase account for 6% of the total content of a hard phase and the binding phase, and WC powder has a particle size of 3.0 μm.

Example 3 provides a rare earth hard alloy, a preparation method of which is as follows:

(1) $Ni_3Al$ powder and an anhydrous yttrium nitrate alcoholic solution were mixed and subjected to a first wet-milling treatment for 12 h to obtain a first material; wherein the amount of the added $Ni_3Al$ powder accounted for 50 wt % of that of the binding phase, and the amount of yttrium in the anhydrous yttrium nitrate alcoholic solution added accounted for 0.5 wt % of that of the binding phase;

(2) the first material was subjected to a high-temperature treatment at 1000° C. under a vacuum condition of 0.1 Pa to obtain a second material;

(3) NbC powder, WC powder and Ni powder were added into the second material and wet milled again for 36 h to obtain a mixture; wherein the total amount of the WC powder accounted for 50 wt % of that of the hard phase, the amount of the added NbC powder accounted for 50 wt % of that of the hard phase, and the amount of the added Ni powder accounted for 49.5 wt % of that of the binding phase; and (4) the mixture was spray dried and compacted, and the green compact was subjected to a low-pressure liquid phase sintering at 1500° C. to obtain a WC—NbC—(Ni—$Ni_3Al$—Y) rare earth hard alloy, i.e., WC-37.6% NbC-6% (Ni—$Ni_3Al$—Y).

Example 4

In the example, the contents of $Ni_3Al$, Y and Ni as a binding phase account for 10% of the total content of a hard phase and the binding phase, and WC powder has a particle size of 0.6 μm.

Example 4 provides a rare earth hard alloy, a preparation method of which is as follows:

(1) $Ni_3Al$ powder and an anhydrous yttrium nitrate alcoholic solution were mixed and subjected to a first wet-milling treatment for 6 h to obtain a first material; wherein the amount of the added $Ni_3Al$ powder accounted for 30 wt % of that of the binding phase, and the amount of yttrium in the anhydrous yttrium nitrate alcoholic solution added accounted for 0.1 wt % of that of the binding phase;

(2) the first material was subjected to a high-temperature treatment at 950° C. under a vacuum condition of 0.05 Pa to obtain a second material;

(3) NbC powder, WC powder and Ni powder were added into the second material and wet milled again for 18 h to obtain a mixture; wherein the total amount of the WC powder accounted for 70 wt % of that of the hard phase, the amount of the added NbC powder accounted for 30 wt % of that of the hard phase, and the amount of the added Ni powder accounted for 69.9 wt % of that of the binding phase; and (4) the mixture was spray dried and compacted, and the green compact was subjected to a low-pressure liquid phase sintering at 1450° C. to obtain a WC—NbC—(Ni—$Ni_3Al$—Y) rare earth hard alloy.

Example 5

In the example, the contents of $Ni_3Al$, Y and Ni as a binding phase account for 10% of the total content of a hard phase and the binding phase, and WC powder has a particle size of 1.5 μm.

Example 5 provides a rare earth hard alloy, a preparation method of which is as follows:

(1) $Ni_3Al$ powder and an anhydrous yttrium nitrate alcoholic solution were mixed and subjected to a first wet-milling treatment for 9 h to obtain a first material; wherein the amount of the added $Ni_3Al$ powder accounted for 40 wt % of that of the binding phase, and the amount of yttrium in the anhydrous yttrium nitrate alcoholic solution added accounted for 0.3 wt % of that of the binding phase;

(2) the first material was subjected to a high-temperature treatment at 1000° C. under a vacuum condition of 0.1 Pa to obtain a second material;

(3) NbC powder, WC powder and Ni powder were added into the second material and wet milled again for 27 h to obtain a mixture; wherein the total amount of the WC powder accounted for 60 wt % of that of the hard phase, the amount of the added NbC powder accounted for 40 wt % of that of the hard phase, and the amount of the added Ni powder accounted for 59.7 wt % of that of the binding phase; and (4) the mixture was spray dried and compacted, and the green compact was subjected to a low-pressure liquid phase sintering at 1450° C. to obtain a WC—NbC—(Ni—$Ni_3Al$—Y) rare earth hard alloy of the invention, i.e., WC-36% NbC-10% (Ni—$Ni_3Al$—Y).

Example 6

In the example, the contents of $Ni_3Al$, Y and Ni as a binding phase account for 10% of the total content of a hard phase and the binding phase, and WC powder has a particle size of 3.0 μm.

Example 6 provides a rare earth hard alloy, a preparation method of which is as follows:

(1) $Ni_3Al$ powder and an anhydrous yttrium nitrate alcoholic solution were mixed and subjected to a first wet-milling treatment for 12 h to obtain a first material; wherein the amount of the added $Ni_3Al$ powder accounted for 50 wt % of that of the binding phase, and the amount of yttrium in the anhydrous yttrium nitrate alcoholic solution added accounted for 0.5 wt % of that of the binding phase;

(2) the first material was subjected to a high-temperature treatment at 900° C. under a vacuum condition of 0.01 Pa to obtain a second material;

(3) NbC powder, WC powder and Ni powder were added into the second material and wet milled again for 36 h to obtain a mixture; wherein the total amount of the WC powder accounted for 50 wt % of that of the hard phase, the amount of the added NbC powder accounted for 50 wt % of that of the hard phase, and the amount of the added Ni powder accounted for 49.5 wt % of that of the binding phase; and (4) the mixture was spray dried and compacted, and the green compact was subjected to a low-pressure liquid phase sintering at 1450° C. to obtain a WC—NbC—(Ni—$Ni_3Al$—Y) rare earth hard alloy.

Example 7

In the example, the contents of $Ni_3Al$, Y and Ni as a binding phase account for 15% of the total content of a hard phase and the binding phase, and WC powder has a particle size of 0.6 μm.

Example 7 provides a rare earth hard alloy, a preparation method of which is as follows:

(1) $Ni_3Al$ powder and an anhydrous yttrium nitrate alcoholic solution were mixed and subjected to a first wet-milling treatment for 6 h to obtain a first material; wherein the amount of the added $Ni_3Al$ powder accounted for 30 wt % of that of the binding phase, and the amount of yttrium in the anhydrous yttrium nitrate alcoholic solution added accounted for 0.1 wt % of that of the binding phase;

(2) the first material was subjected to a high-temperature treatment at 1000° C. under a vacuum condition of 0.1 Pa to obtain a second material;

(3) NbC powder, WC powder and Ni powder were added into the second material and wet milled again for 18 h to obtain a mixture; wherein the total amount of the WC powder accounted for 70 wt % of that of the hard phase, the amount of the added NbC powder accounted for 30 wt % of that of the hard phase, and the amount of the added Ni powder accounted for 69.9 wt % of that of the binding phase; and (4) the mixture was spray dried and compacted, and the green compact was subjected to a low-pressure liquid phase sintering at 1410° C. to obtain a WC—NbC—(Ni—$Ni_3Al$—Y) rare earth hard alloy.

Example 8

In the example, the contents of $Ni_3Al$, Y and Ni as a binding phase account for 15% of the total content of a hard phase and the binding phase, and WC powder has a particle size of 1.5 μm.

Example 8 provides a rare earth hard alloy, a preparation method of which is as follows:

(1) $Ni_3Al$ powder and an anhydrous yttrium nitrate alcoholic solution were mixed and subjected to a first wet-milling treatment for 9 h to obtain a first material; wherein the amount of the added $Ni_3Al$ powder accounted for 40 wt % of that of the binding phase, and the amount of yttrium in the anhydrous yttrium nitrate alcoholic solution added accounted for 0.3 wt % of that of the binding phase;

(2) the first material was subjected to a high-temperature treatment at 900° C. under a vacuum condition of 0.01 Pa to obtain a second material;

The proportions of the raw materials and preparation parameters of Examples 1 to 9 are listed in Table 1 below, and each of the percentages (%) in the table indicates the mass percentage of the corresponding substance in the total of the hard phase and the binding phase.

TABLE 1

| | WC particle size/μm | Addition amount of $Ni_3Al$/% | Addition amount of yttrium/% | First wet-milling time/h | Treatment temperature/° C. | Vacuum condition/Pa | Addition amount of NbC/% | Addition amount of WC/% | Addition amount of Ni/% | Second wet-milling time/h | Sintering temperature/° C. | Content of binding phase/% |
|---|---|---|---|---|---|---|---|---|---|---|---|---|
| Example 1 | 0.6 | 1.8 | 0.006 | 6 | 900 | 1.01 | 28.2 | 65.8 | 4.194 | 18 | 1,500 | 6 |
| Example 2 | 1.5 | 2.4 | 0.018 | 9 | 950 | 0.05 | 37.6 | 56.4 | 3.582 | 27 | 1,500 | 6 |
| Example 3 | 3.0 | 3.0 | 0.030 | 12 | 1,000 | 0.1 | 47.0 | 47.0 | 2.970 | 36 | 1,500 | 6 |
| Example 4 | 0.6 | 3.0 | 0.010 | 6 | 900 | 0.05 | 27.0 | 63.0 | 6.990 | 18 | 1,450 | 10 |
| Example 5 | 1.5 | 4.0 | 0.030 | 9 | 950 | 0.1 | 36.0 | 54.0 | 5.970 | 27 | 1,450 | 10 |
| Example 6 | 3.0 | 5.0 | 0.050 | 12 | 1,000 | 0.01 | 45.0 | 45.0 | 4.950 | 36 | 1,450 | 10 |
| Example 7 | 0.6 | 4.5 | 0.015 | 6 | 900 | 0.1 | 25.5 | 59.5 | 10.485 | 18 | 1,410 | 15 |
| Example 8 | 1.5 | 6.0 | 0.045 | 9 | 950 | 0.01 | 34.0 | 51.0 | 8.955 | 27 | 1,410 | 15 |
| Example 9 | 3.0 | 7.5 | 0.075 | 12 | 1,000 | 0.05 | 42.5 | 42.5 | 7.425 | 36 | 1,410 | 15 |

(3) NbC powder, WC powder and Ni powder were added into the second material and wet milled again for 27 h to obtain a mixture; wherein the total amount of the WC powder accounted for 60 wt % of that of the hard phase, the amount of the added NbC powder accounted for 40 wt % of that of the hard phase, and the amount of the added Ni powder accounted for 59.7 wt % of that of the binding phase; and (4) the mixture was spray dried and compacted, and the green compact was subjected to a low-pressure liquid phase sintering at 1410° C. to obtain a WC—NbC—(Ni—$Ni_3Al$—Y) rare earth hard alloy, i.e., WC-34% NbC-15% (Ni—$Ni_3Al$—Y).

Example 9

In the example, the contents of $Ni_3Al$, Y and Ni as a binding phase account for 15% of the total content of a hard phase and the binding phase, and WC powder has a particle size of 3.0 μm.

Example 9 provides a rare earth hard alloy, a preparation method of which is as follows:

(1) $Ni_3Al$ powder and an anhydrous yttrium nitrate alcoholic solution were mixed and subjected to a first wet-milling treatment for 12 h to obtain a first material; wherein the amount of the added $Ni_3Al$ powder accounted for 50 wt % of that of the binding phase, and the amount of yttrium in the anhydrous yttrium nitrate alcoholic solution added accounted for 0.5 wt % of that of the binding phase;

(2) the first material was subjected to a high-temperature treatment at 950° C. under a vacuum condition of 0.05 Pa to obtain a second material;

(3) NbC powder, WC powder and Ni powder were added into the second material and wet milled again for 36 h to obtain a mixture; wherein the total amount of the WC powder accounted for 50 wt % of that of the hard phase, the amount of the added NbC powder accounted for 50 wt % of that of the hard phase, and the amount of the added Ni powder accounted for 49.5 wt % of that of the binding phase; and (4) the mixture was spray dried and compacted, and the green compact was subjected to a low-pressure liquid phase sintering at 1410° C. to obtain a WC—NbC—(Ni—$Ni_3Al$—Y) rare earth hard alloy.

Comparative Example 1

In Comparative Example 1, the contents of $Ni_3Al$ and Y as a binding phase account for 6% of the total content of a hard phase and the binding phase, and WC powder serves as the hard phase and has a particle size of 1.5 μm.

Comparative Example 1 provides a hard alloy, a preparation method of which is as follows:

(1) $Ni_3Al$ powder and an anhydrous yttrium nitrate alcoholic solution were mixed and subjected to a first wet-milling treatment for 9 h to obtain a first material; wherein the amount of the added $Ni_3Al$ powder accounted for 40 wt % of that of the binding phase, and the amount of yttrium in the anhydrous yttrium nitrate alcoholic solution added accounted for 0.3 wt % of that of the binding phase;

(2) the first material was subjected to a high-temperature treatment at 950° C. under a vacuum condition of 0.05 Pa to obtain a second material;

(3) WC powder was added into the second material and wet milled again for 27 h to obtain a mixture; wherein the total amount of the WC powder accounted for 94 wt % of the total content of the hard phase and the binding phase; and (4) the mixture was spray dried and compacted, and the green compact was subjected to a low-pressure liquid phase sintering at 1500° C. to obtain a WC-6% ($Ni_3Al$—Y) hard alloy, i.e., WC-6% ($Ni_3Al$—Y).

Comparative Example 2

In Comparative Example 2, the contents of $Ni_3Al$ and Y as a binding phase account for 10% of the total content of a hard phase and the binding phase, and WC powder serves as the hard phase and has a particle size of 1.5 μm.

Comparative Example 2 provides a hard alloy, a preparation method of which is as follows:

(1) $Ni_3Al$ powder and an anhydrous yttrium nitrate alcoholic solution were mixed and subjected to a first wet-milling treatment for 9 h to obtain a first material; wherein the amount of the added $Ni_3Al$ powder accounted for 40 wt % of that of the binding phase, and the amount of yttrium in the anhydrous yttrium nitrate alcoholic solution added accounted for 0.3 wt % of that of the binding phase;

(2) the first material was subjected to a high-temperature treatment at 1000° C. under a vacuum condition of 0.1 Pa to obtain a second material;

(3) WC powder was added into the second material and wet milled again for 27 h to obtain a mixture; wherein the total amount of the WC powder accounted for 90 wt % of the total content of the hard phase and the binding phase; and (4) the mixture was spray dried and compacted, and the green compact was subjected to a low-pressure liquid phase sintering at 1450° C. to obtain a WC-10% ($Ni_3Al$—Y) hard alloy, i.e., WC-10% ($Ni_3Al$—Y).

Comparative Example 3

In Comparative Example 3, the contents of $Ni_3Al$ and Y as a binding phase account for 15% of the total content of a hard phase and the binding phase, and WC powder serves as the hard phase and has a particle size of 1.5 μm.

Comparative Example 3 provides a hard alloy, a preparation method of which is as follows:

(1) $Ni_3Al$ powder and an anhydrous yttrium nitrate alcoholic solution were mixed and subjected to a first wet-milling treatment for 9 h to obtain a first material; wherein the amount of the added $Ni_3Al$ powder accounted for 40 wt % of that of the binding phase, and the amount of yttrium in the anhydrous yttrium nitrate alcoholic solution added accounted for 0.3 wt % of that of the binding phase;

(2) the first material was subjected to a high-temperature treatment at 900° C. under a vacuum condition of 0.01 Pa to obtain a second material;

(3) WC powder was added into the second material and wet milled again for 27 h to obtain a mixture; wherein the total amount of the WC powder accounted for 85 wt % of the total content of the hard phase and the binding phase; and (4) the mixture was spray dried and compacted, and the green compact was subjected to a low-pressure liquid phase sintering at 1450° C. to obtain a WC-15% ($Ni_3Al$—Y) hard alloy, i.e., WC-15% ($Ni_3Al$—Y).

Comparative Example 4

In Comparative Example 4, the content of Ni powder as a binding phase accounts for 10% of the total content of a hard phase and the binding phase, and WC powder has a particle size of 1.5 μm.

Comparative Example 4 provides a hard alloy, a preparation method of which is as follows:

(1) WC powder, NbC powder and Ni powder were wet milled for 27 h to obtain a mixture; wherein the total amount of the WC powder accounted for 54 wt %, the amount of the added NbC powder accounted for 36 wt %, and the amount of the added Ni powder accounted for 10 wt %; and (2) the mixture was spray dried and compacted, and the green compact was subjected to a low-pressure liquid phase sintering at 1450° C. to obtain a WC-36% NbC-10% Ni hard alloy, i.e., (WC-36% NbC-10% Ni).

Comparative Example 5

In Comparative Example 5, the contents of $Ni_3Al$, Y and Ni as a binding phase account for 10% of the total content of a hard phase and the binding phase, and WC powder has a particle size of 1.5 μm.

Comparative Example 5 provides a hard alloy, a preparation method of which is as follows:

(1) the first portion of WC powder and $Ni_3Al$ powder were mixed with an anhydrous yttrium nitrate alcoholic solution and subjected to a first wet-milling treatment for 9 h to obtain a first material; wherein the amount of the added $Ni_3Al$ powder accounted for 40 wt % of that of the binding phase, and the amount of yttrium in the anhydrous yttrium nitrate alcoholic solution added accounted for 0.3 wt % of that of the binding phase;

(2) the first material was subjected to a high-temperature treatment at 1000° C. under a vacuum condition of 0.1 Pa to obtain a second material;

(3) WC powder and Ni powder were added into the second material and wet milled again for 27 h to obtain a mixture; wherein the total amount of the WC powder accounted for 90 wt % of the total content of the hard phase and the binding phase, and the amount of the added Ni powder accounted for 59.7 wt % of that of the binding phase; and (4) the mixture was spray dried and compacted, and the green compact was subjected to a low-pressure liquid phase sintering at 1450° C. to obtain a WC-10% (Ni—$Ni_3Al$—Y) hard alloy, i.e., WC-10% (Ni—$Ni_3Al$—Y).

Comparative Example 6

In Comparative Example 6, the contents of $Ni_3Al$, Y and Ni as a binding phase account for 10% of the total content of a hard phase and the binding phase, and WC powder has a particle size of 0.6 μm.

Comparative Example 6 provides a hard alloy, a preparation method of which is as follows:

(1) $Ni_3Al$ powder, an anhydrous yttrium nitrate alcoholic solution, NbC powder, WC powder and Ni powder were wet milled again for 18 h to obtain a mixture; wherein the total amount of the WC powder accounted for 70 wt % of that of the hard phase, the amount of the added NbC powder accounted for 30 wt % of that of the hard phase, the amount of the added $Ni_3Al$ powder accounted for 30 wt % of that of the binding phase, the amount of yttrium in the anhydrous yttrium nitrate alcoholic solution added accounted for 0.1 wt % of that of the binding phase, and the amount of the added Ni powder accounted for 69.9 wt % of that of the binding phase; and (2) the mixture was spray dried and compacted, and the green compact was subjected to a low-pressure liquid phase sintering at 1450° C. to obtain a WC—NbC—(Ni—$Ni_3Al$—Y) hard alloy.

A test method of the high-temperature oxidation resistance at 1000° C./2h: a sample adopted has a diameter of 50 mm and a height of 5 mm. The surface of the sample is ground flat and polished, and placed in a common heat treatment furnace for an oxidation experiment. That is, under the condition of air admission, the sample is heated to 1000° C. and maintained for 2 h, the mass of the sample before and after oxidation is weighed with a balance (accuracy of 1/10,000 g), and the mass increment per unit area is used to characterize the oxidation condition. The smaller the increment is, the better the high-temperature oxidation resistance of the sample is.

A test method of the high-temperature bending strength: test is carried out at 25° C., 500° C. and 800° C. respectively, according to the national standard "GB/T3851-2015".

A test method of the room-temperature fracture toughness:, test is carried out according to the national standard "JB T 12616-2016 Inspection Methods of Fracture Toughness for Hardmetals Tool Base Material".

Figure 2:
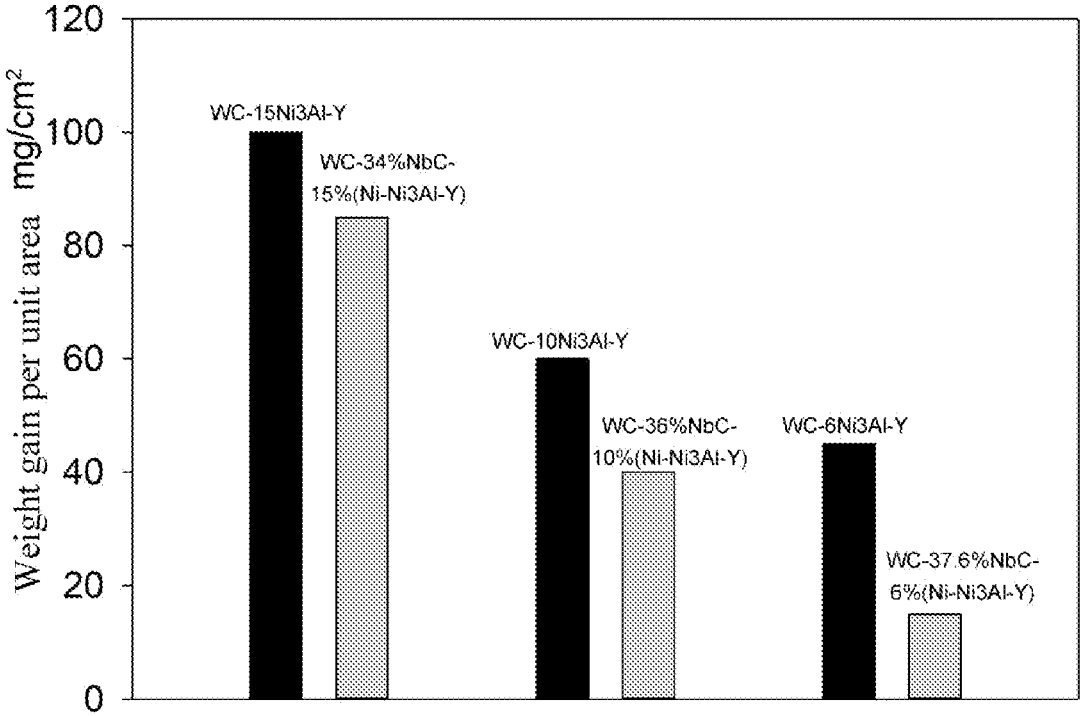
FIG. 2 is a comparison diagram of test results of the high-temperature oxidation resistance between rare earth hard alloys of Examples 2, 5 and 8 of the present invention and rare earth hard alloys of Comparative Examples 1 to 3.
Figure 3:
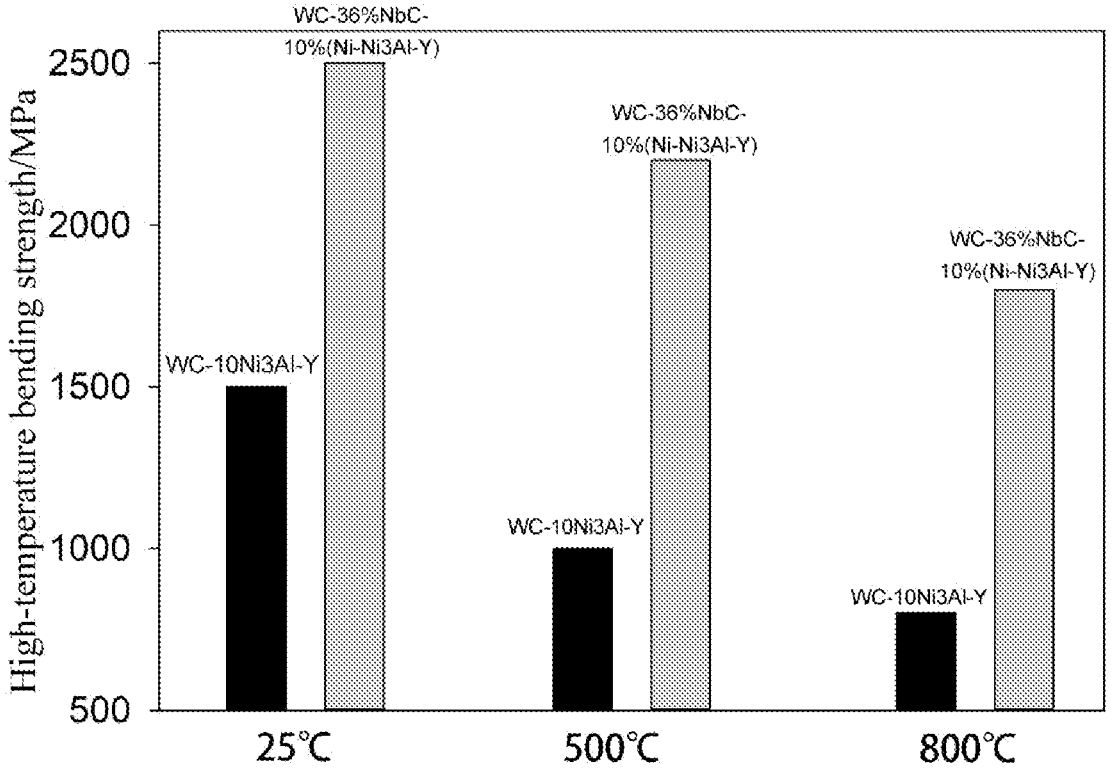
FIG. 3 is a comparison diagram of test results of the high-temperature bending strength between the rare earth hard alloys of Examples 2, 5 and 8 of the present invention and the rare earth hard alloys of Comparative Examples 1 to 3.
Figure 4:
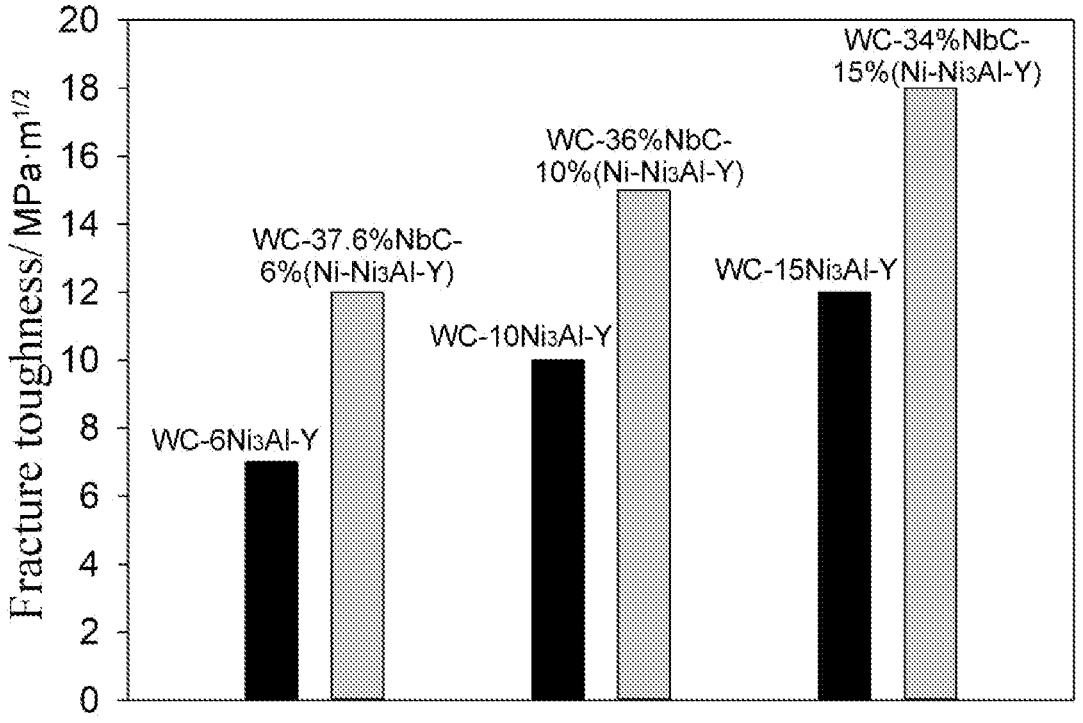
FIG. 4 is a comparison diagram of test results of the room-temperature fracture toughness between the rare earth hard alloys of Examples 2, 5 and 8 of the present invention and the rare earth hard alloys of Comparative Examples 1 to 3.
Figure 5:
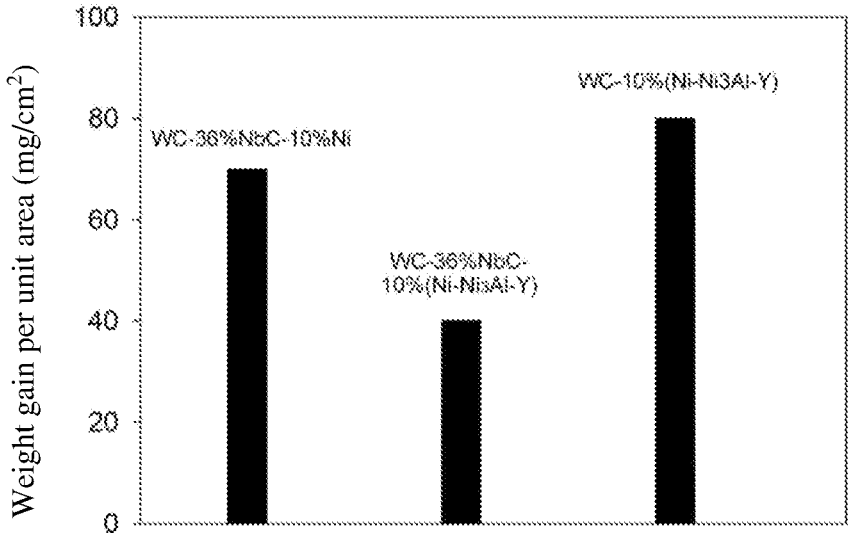
FIG. 5 is a comparison diagram of test results of the high-temperature oxidation resistance between the rare earth hard alloy of Example 5 of the present invention and rare earth hard alloys of Comparative Examples 4 and 5.
Figure 6:
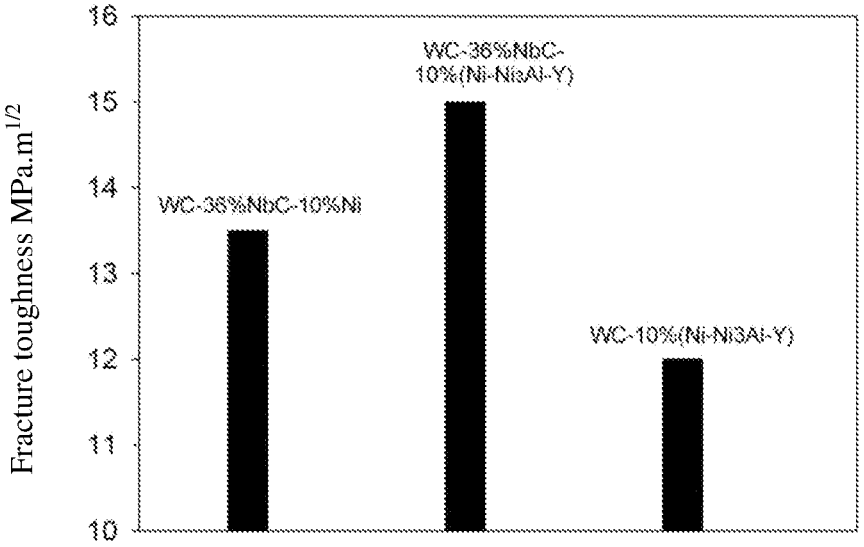
FIG. 6 is a comparison diagram of test results of the room-temperature fracture toughness between the rare earth hard alloy of Example 5 of the present invention and the rare earth hard alloys of Comparative Examples 4 and 5.
Figure 7:
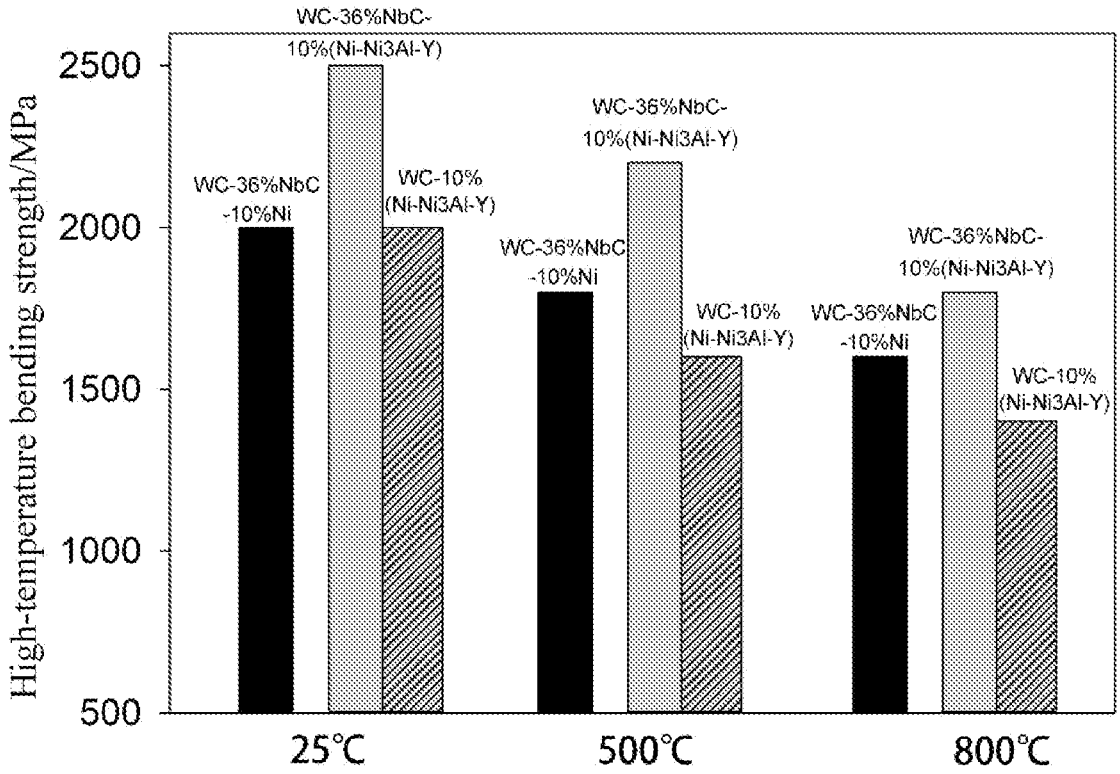
FIG. 7 is a comparison diagram of test results of the high-temperature bending strength between the rare earth hard alloy of Example 5 of the present invention and the rare earth hard alloys of Comparative Examples 4 and 5.

FIG. 1 shows the structure of the rare earth hard alloy of Example 5; FIG. 2 is a comparison diagram of test results of the high-temperature oxidation resistance between Examples 2, 5 and 8 of the present invention and Comparative Examples 1 to 3; FIG. 3 is a comparison diagram of test results of the high-temperature bending strength between Example 5 of the present invention and Comparative Example 2; FIG. 4 is a comparison diagram of test results of the room-temperature fracture toughness between Examples 2, 5 and 8 of the present invention and Comparative Examples 1 to 3; FIG. 5 is a comparison diagram of test results of the high-temperature oxidation resistance between Example 5 of the present invention and Comparative Examples 4 and 5; FIG. 6 is a comparison diagram of test results of the room-temperature fracture toughness between Example 5 of the present invention and Comparative Examples 4 and 5; and FIG. 7 is a comparison diagram of test results of the high-temperature bending strength between Example 5 of the present invention and Comparative Examples 4 and 5.

It can be obviously seen from FIGS. 2 to 7 above that, compared with Comparative Examples 1 to 5, the WC—NbC—(Ni—$Ni_3Al$—Y) rare earth hard alloy obtained in Examples 2, 5 and 8 of the invention is significantly improved in the high-temperature oxidation resistance, the high-temperature bending strength and the room-temperature fracture toughness, all of which are improved by 20% or above.

Furthermore, the room-temperature fracture toughness and the high-temperature bending strength of the hard alloys obtained in Example 4 and Comparative Example 6 are detected through the above methods and compared. The results show that both the fracture toughness and the high-temperature bending strength of the rare earth hard alloy prepared in Example 4 are superior to those of Comparative Example 6.

It is to be noted that, the aforementioned examples are intended to explain the present invention only and do not constitute any limitation to the present invention. The invention is described with reference to typical examples, but it is to be understood that the words used therein are descriptive and explanatory rather than restrictive. The invention may be modified within the scope of the claims of the invention as specified, and may be revised without departing from the scope and spirit of the invention. Although the invention described therein relates to specific methods, materials and examples, it is not intended that the invention is limited to the particular examples disclosed therein; rather, the invention can be extended to all other methods and applications having the same function.

The invention claimed is:

1. A rare earth hard alloy, comprising, based on a weight of the hard alloy, 6 to 15 wt % of a binding phase and balance of a hard phase, wherein based on a weight of the binding phase, the binding phase comprises 30 to 50 wt % of $Ni_3Al$, 0.1 to 0.5 wt % of a rare earth element and balance of Ni, the rare earth element being Y;

based on the weight of the hard phase, the hard phase includes 30 to 50 wt % of NbC and balance of WC; and a preparation method of the rare earth hard alloy comprises steps of:

S1. mixing $Ni_3Al$ powders and a rare earth element source solution, and performing a first wet-milling treatment to obtain a first material;

S2. performing a high-temperature treatment on the first material to obtain a second material;

S3. mixing the second material, NbC powders, WC powders and Ni powders and performing a second wet-milling treatment to obtain a mixture; and S4. drying, pressing and sintering the mixture to obtain the rare earth hard alloy.

2. The rare earth hard alloy according to claim 1, characterized in that, the WC powder has a particle size of from 0.6 to 3.0 μm.

3. The rare earth hard alloy according to claim 1, characterized in that, in the rare earth element source solution, a rare earth element is Y; and the rare earth element source solution is a salt solution of the rare earth element.

4. The rare earth hard alloy according to claim 3, characterized in that, the rare earth element source solution is an anhydrous nitrate solution of the rare earth element.

5. The rare earth hard alloy according to claim 4, characterized in that, the rare earth element source solution is an anhydrous yttrium nitrate alcoholic solution.

6. The rare earth hard alloy according to claim 1, characterized in that, by a total weight of 100% of the $Ni_3Al$ powders, the rare earth element in the rare earth element source solution and the Ni powders, the $Ni_3Al$ powders are present in an amount of from 30 to 50%, and the rare earth element in the rare earth element source solution is present in an amount of from 0.1 to 0.5%.

7. The rare earth hard alloy according to claim 1, characterized in that, by a total weight of 100% of the NbC powders and the WC powders, the NbC powders are present in an amount of from 30 to 50 wt %.

8. The rare earth hard alloy according to claim 1, characterized in that, in the step S1, the first wet-milling treatment is performed for 6 to 12 h; and/or in the step S2, the high-temperature treatment is performed at a temperature of from 900 to 1000° C.;

in the step S3, the second wet-milling treatment is performed for 18 to 36 h; and/or in the step S4, the sintering treatment is performed at a temperature of from 1410° C. to 1500° C.

9. The rare earth hard alloy according to claim 8, characterized in that, in the step S2, the high-temperature treatment is performed under a vacuum condition.

10. The rare earth hard alloy according to claim 9, characterized in that, the high-temperature treatment is performed under a vacuum condition of from 0.01 to 0.1 Pa.

* * * * *